US010988349B2

(12) United States Patent
Haas et al.

(10) Patent No.: US 10,988,349 B2
(45) Date of Patent: Apr. 27, 2021

(54) ANCHOR POINT WITH MOVABLE TILT AXIS

(71) Applicant: RUD KETTEN RIEGER & DIETZ GMBH U. CO. KG, Aalen (DE)

(72) Inventors: Simon Haas, Goggingen-Horn (DE); Reinhard Smetz, Nordlingen-Kleinerdlingen (DE)

(73) Assignee: Rud Ketten Rieger & Dietz GmbH u. Co. KG

( * ) Notice: Subject to any disclaimer, the term of this patent is extended or adjusted under 35 U.S.C. 154(b) by 255 days.

(21) Appl. No.: 15/778,037

(22) PCT Filed: Nov. 23, 2016

(86) PCT No.: PCT/EP2016/078526

§ 371 (c)(1),
(2) Date: May 22, 2018

(87) PCT Pub. No.: WO2017/089378

PCT Pub. Date: Jun. 1, 2017

(65) Prior Publication Data

US 2018/0346288 A1 Dec. 6, 2018

(30) Foreign Application Priority Data

Nov. 24, 2015 (DE) ..... 10 2015 223 161.5

(51) Int. Cl.
*B66C 1/66* (2006.01)

(52) U.S. Cl.
CPC ..... *B66C 1/66* (2013.01)

(58) Field of Classification Search
CPC ..... B66C 1/66
(Continued)

(56) References Cited

U.S. PATENT DOCUMENTS 3,371,951 A * 3/1968 Bryant ..... B66C 1/66 294/82.1
3,482,817 A * 12/1969 Ross ..... B66C 1/66 254/133 R (Continued)

FOREIGN PATENT DOCUMENTS

CN 1078211 11/1993
CN 201016082 2/2008

(Continued)

OTHER PUBLICATIONS

Search Report issued by the German Patent and Trademark Office in Application No. 10 2015 223 161.5, dated Nov. 17, 2016.

(Continued)

*Primary Examiner* — Paul T Chin
(74) *Attorney, Agent, or Firm* — Barnes & Thornburg LLP; Jeffrey R. Stone

(57) ABSTRACT

An anchor point (1) for e.g. lifting and/or lashing down an object (2) includes a base (4), which is configured for fixing to the object (2) such that it is rotatable about an axis of rotation (7). The anchor point (1) also includes a retainer bracket (3) held on two bearing points (5) on the base (4) such that it is tiltable about a tilt axis (11) relative to the base (4). In order to prevent the retainer bracket (3) from getting stuck when a force is applied thereto, which may lead to a sudden and jerky turnover of the retainer bracket or even to fracturing of the anchor point (1) and crashing of the load, the tilt axis (11) is movable relative to the base (4). Preferably, a motion link (25), for example, is provided on at least one bearing point (5).

13 Claims, 4 Drawing Sheets

(58) Field of Classification Search
USPC ..... 294/82.22, 82.1, 215, 89; 248/499; 410/101
See application file for complete search history.

(56) References Cited

U.S. PATENT DOCUMENTS 3,792,892 A * 2/1974 Shields ..... B66C 1/12 294/82.1
3,892,436 A 7/1975 Fathauer
4,408,941 A * 10/1983 Motz ..... B66C 1/666 411/378
4,570,987 A 2/1986 Wong et al.
4,669,618 A * 6/1987 Brand ..... B66C 1/66 212/271
4,702,508 A * 10/1987 Weiner ..... B66C 1/48 116/208
5,405,210 A 4/1995 Tsui
5,634,734 A * 6/1997 Schron, Jr. ..... B66C 1/66 294/215
6,039,500 A * 3/2000 Kwon ..... B66C 1/66 294/215
6,068,310 A * 5/2000 Fuller ..... B66C 1/66 294/215
6,443,514 B1 * 9/2002 Fuller ..... B66C 1/66 294/215
6,547,474 B1 * 4/2003 Smetz ..... B60P 7/0807 403/150
6,652,012 B1 * 11/2003 Fuller ..... B66C 1/66 294/215
2005/0069379 A1 * 3/2005 Smetz ..... B66C 1/66 403/164
2017/0144866 A1 * 5/2017 Smetz ..... B60P 7/0807
2017/0174478 A1 * 6/2017 Smetz ..... B66C 1/66

FOREIGN PATENT DOCUMENTS

| | | |
|---|---|---|
| DE | 8428646 | 9/1984 |
| DE | 68917320 | 12/1994 |
| DE | 10062972 | 7/2002 |
| DE | 69927493 | 6/2006 |
| DE | 4321497 | 3/2012 |
| DE | 202014100732 | 4/2014 |
| EP | 1069067 | 1/2001 |
| EP | 2241527 | 10/2010 |
| EP | 2431620 | 3/2012 |
| WO | 1990/10803 | 9/1990 |

OTHER PUBLICATIONS

International Search Report dated Feb. 14, 2017, issued in related PCT application No. PCT/EP2016/078526.

* cited by examiner

ANCHOR POINT WITH MOVABLE TILT AXIS

The present invention relates to an anchor point comprising a base, which is configured for fixing to an object such that it is rotatable about an axis of rotation, and further comprising a retainer bracket for fastening a fastening means, the retainer bracket being held on two bearing points on the base such that it is tiltable about a tilt axis relative to the base.

Such anchor points are known. They are attached, e.g. by means of welding or screwing on, to an object to be lifted, to be lashed down or to be acted upon with a force in some other way. The retainer bracket or shackle may have attached thereto fastening means in the form of pulling, lifting or lashing means, such as hooks, karabiners, belts, ropes, chains or ring and connection elements.

Anchor points of the type described e.g. in DE 43 21 497 B4, EP 2 241 527 B1, EP 2 431 620 B1, DE 201 19 132, DE 699 27 493 T2, DE 10 2012 107 733 A1 and DE 20 2014 100 732 U1 allow a self-orientation of the retainer bracket in the direction of the force applied from the fastening means insofar as the retainer bracket can simultaneously be rotated about the axis of rotation and tilted. If a force acts on the fastening means fastened to the anchor point, the retainer bracket or fastening bracket will be able to orient itself automatically in the direction of said force and assume a position that is advantageous for the flow of force from the fastening means to the object.

The known anchor points are, however, disadvantageous insofar as, in certain load situations, in particular when the force applied to the retainer bracket passes through the axis of rotation of the anchor point and when, simultaneously, the plane of the retainer bracket lies in the plane defined by the axis of rotation and said force, the retainer bracket will not orient itself gradually but remain at the position in question. This may result not only in a sudden and jerky turnover of the retainer bracket but also in fracturing of the anchor point and crashing of the load, since the breaking forces accomplished in this load direction are much smaller due to the longer lever arm.

Hence, it is the object of the present invention to provide an anchor point that is able to orient itself, in any load situation and without a sudden turnover, in the direction of a force acting on the retainer bracket.

According to the present invention, this object is achieved in that the tilt axis is movable relative to the base.

This simple solution prevents a sudden turnover, since the tilt axis will be able to follow the force acting on the retainer bracket, and this will lead to an asymmetrical load. This asymmetry prevents the retainer bracket from getting stuck in the above described load situation. In contrast to this simple solution, the anchor points of the references cited at the beginning are provided with a tilt axis that is not movable relative to the base.

The solution according to the present invention can be improved still further by the embodiments described hereinafter, which are each individually advantageous and which can be combined in an arbitrary manner.

For example, at least one bearing point of the retainer bracket may comprise a bearing pin. Thus, it will be possible to manufacture the retainer bracket as a casting or as a forging. The bearing pin may be accommodated in a reception means of the base. Alternatively or cumulatively, a bearing pin may also be formed from the base and received in a reception means of the retainer bracket. In the case of this type of structural design, the reception means will then define the bearing point of the pin.

The movability of the tilt axis relative to the base can be accomplished, when the bearing pin is supported in the reception means such that it is able to carry out a rotary and a translational movement.

The movability of the tilt axis relative to the base should exceed by far a normal, mostly unavoidable bearing play. The movability may in particular amount to more than one fifth up to approximately three times the diameter of the bearing pin.

According to a further advantageous embodiment, a mechanical constraining guide of at least one bearing point in at least one predetermined direction may be provided for guaranteeing a controlled movability of this bearing point. This mechanical constraining guide can be established by a suitable shape of the bearing pin and/or of the reception means. The mechanical constraining guide allows only limited evasive movements of the tilt axis in the direction predetermined by the constraining guide. The mechanical constraining guide may, for example, be configured as a linear guide, if it allows only a movement of the tilt axis and of the bearing point, respectively, along a straight and/or curved line.

The bearing pin need not have a circular cross-section. It may also comprise only at least one circular section and may e.g. have the shape of a cam or it may be oval or elliptical in shape. According to a further embodiment, at least one section of the bearing pin may have a straight cross-section.

It will be particularly advantageous for the self-orientation of the anchor point according to the present invention in load situations, in which the known anchor points having a rigid tilt axis tend to suddenly turn over or fail, when the tilt axis is tiltable relative to the base about the axis of rotation and/or relative to the base about an axis extending perpendicular to the axis of rotation. The last-mentioned movability allows e.g. a bearing point of the retainer bracket to be displaced along the axis of rotation relative to the other bearing point, i.e. away from the object having the anchor point attached thereto. A combination of these two directions of movement of the tilt axis relative to the base is particularly advantageous.

According to a further advantageous embodiment, the bearing points may be held on the base such that they are movable relative to the base in the direction of rotation of the latter and/or in the direction of the axis of rotation. Also here, a combination of both directions of movement is particularly advantageous. In the case of such a structural design, the constraining guide may extend such that it is inclined relative to the axis of rotation.

According to a further advantageous embodiment, the tilt axis or at least one of the bearing points may be held on the base such that, preferably under load, they are automatically movable from a first operating position to a second operating position. At the first operating position, the two bearing points may be located on the same level and at the second operating position on different levels of the axis of rotation. Alternatively or cumulatively, the tilt axis or at least one of the bearing points may, at the second operating position, be rotated relative to the base about the axis of rotation with respect to its position at the first operating position.

A particular advantage is achieved, when the mechanical constraining guide or the reception means of at least one bearing point is configured as a motion link. The at least one motion link may be provided on the base. In said motion link, at least one of the bearing points, in particular a bearing pin, is guided such that it is movable relative to the base. Due to the guidance of the bearing point, such a motion link causes a controlled movement in load situations. By means of said motion link guidance, a gradual orientation of the retainer bracket under load can take place in a particularly effective manner, without any risk of temporary jamming. Preferably, a separate motion link is provided for each bearing point.

The motion link may define an, in particular slot-shaped, reception means for a bearing pin, which is thus positively guided in the motion link.

If a motion link is provided for each of the two bearing points, said motion links should be diametrically opposed relative to the axis of rotation.

If a plurality of motion links is provided, one of these motion links may be arranged on the base relative to the other motion link in a mirror-inverted mode with respect to a radial plane.

According to a further variant, the motion links may be configured symmetrically with respect to a radial plane comprising the axis of rotation, so as to allow a symmetrical movement of the tilt axis to both directions of the radial plane in a load situation.

Since a positively guided combination of a rotary movement and of a tilting movement of the tilt axis seems to be very effective for avoiding a sudden turnover of the retainer bracket, it will be of advantage, when the motion link comprises at least one guide section in which the bearing point is guided such that it is movable at an oblique angle relative to a radial plane comprising the axis of rotation. The inclined guide has the effect that, when moving along the motion link, the tilt axis will execute simultaneously a rotary and a tilting movement. The guide section may extend at an acute angle relative to the radial plane, in particular at an angle between 30° and 60°.

When the two motion links are disposed on the base diametrically opposed relative to the axis of rotation, the rotary and the tilting movement of the tilt axis can be increased, if each of the two diametrically opposed motion links has such a guide section, the guide section of one of the motion links being inclined in a direction opposite to the direction of inclination of the diametrically opposed guide section.

In order to allow simultaneous tilting and rotating of the tilt axis of the retainer bracket in both directions, at least one motion link may have two guide sections, which, with respect to the radial plane, are inclined in opposite directions relative to one another. The two guide sections may especially be arranged in a V-shape. Between the two guide sections, a projection may be arranged on the motion link side that is more remote from the retainer bracket. If a plurality of motion links is provided, each motion link may comprise two guide sections arranged in this way.

According to a further advantageous embodiment, the motion link may comprise for the bearing point two end halt points spaced apart in the direction of rotation of the base and one intermediate halt point, said intermediate halt point being located between the two end halt points in the direction of rotation of the base and displaced relative to the halt points in the direction of the axis of rotation. The end halt points preferably block the movement of the bearing point perpendicular to the axis of rotation, thus serving to absorb a force applied to the retainer bracket and directed perpendicular to the axis of rotation and in the direction of rotation, respectively. The intermediate halt point preferably blocks the movement of the at least one bearing point along the axis of rotation in a direction away from the load-side end of the base, at which the latter is fastened to a load or to some other object. The intermediate halt point thus serves to absorb a force applied to the retainer bracket and directed in the direction of the axis of rotation away from the base.

The motion link is preferably configured such that the at least one bearing point is freely movable between the end halt points and the intermediate halt point located therebetween. Under this aspect, it is therefore of advantage when the motion link extends smoothly between the halt points, i.e. without any offsets or steps.

It is also of advantage when the end halt points are located closer to the base end to be fastened to the object than the intermediate halt point. This has the effect that, in the case of a force acting perpendicular to the fastening of the anchor point and entailing the risk of levering out the fastening of the anchor point, a smaller moment will act on the fastening. This smaller moment is achieved by shifting the end halt points towards the object at which the anchor point is to be fastened.

Motion links having a very simple geometrical design may not comprise an intermediate halt point.

An advantageous combination of the above described characteristics can be accomplished when the motion link is substantially heart-shaped. The top of the heart, which is preferably rounded, so that the bearing point can enter into close contact therewith, is here directed away from the base end to be fastened to the object. In particular, the top of the heart may define the intermediate halt point of the motion link. The two wings of the heart are preferably located on the same level of the axis of rotation. They may define the end halt points.

The at least one bearing point, the bearing pin and/or the motion link may have provided thereon a wear indicator, which is arranged such that it can be viewed through the motion link from outside the anchor point. In the case of this embodiment, the motion link fulfills a dual function not only as a guide of the bearing point but also as a window, which, for the purpose of maintenance, allows a view of the wear indicator. The wear indicator may be configured in the form of at least one groove or rib. This structural design is independent of whether the bearing point is configured as a bearing pin or as a reception means.

Furthermore, it will be of advantage when, at least in a condition in which the retainer bracket extends transversely to the axis of rotation under load, the bearing points are located closer to the load-side end of the base than in a condition in which the retainer bracket extends in the direction of the axis of rotation. As has already been described hereinbefore in connection with the not necessarily provided motion link, this leads to a smaller load moment on the fastening of the anchor point on the object.

The reception means or the mechanical constraining guide need not necessarily be configured as a motion link. The bearing pin need not have a symmetrical cross-section. A reliable orientation of the retainer bracket in the direction of the force acting thereon can be accomplished with or without a motion link, when the bearing pin is configured such that it is asymmetrical, in particular with respect to a radial plane extending through the tilt axis and the axis of rotation, and has an asymmetrical cross-section, respectively. The bearing pin may have a contact point on its end facing away from the retainer bracket, said contact point being, especially when the retainer bracket is oriented along the axis of rotation, displaced from the tilt axis and from the radial plane, respectively, on the level of the reception means. If, due to a force acting on the reception means, the contact point enters into contact with the reception means, the displacement will result in a moment that will immediately orient the retainer bracket along the force acting thereon. If the bearing pin is asymmetrical, the reception means should be sufficiently large for allowing a movability of the tilt axis along the axis of rotation of the base and transversely thereto.

If an asymmetrical bearing pin is used together with the motion link, it will be of advantage when the contact point projects into a guide section of the motion link in a condition in which the retainer bracket is oriented along the axis of rotation. This structural design allows to prevent the bearing pin from entering into unstable contact with a projection dividing the motion link into two guide sections. Under load, the bearing pin will slide into the guide section into which the contact point already projects.

In the following, the present invention will exemplarily be described in more detail on the basis of embodiments and with reference to the drawings. In so doing, identical reference numerals will, for the sake of simplicity, be used in the figures for elements corresponding to one another as regards function and/or structural design. In addition, it should be taken into account that, in accordance with the above described structural designs, individual elements of the embodiments can be omitted or added, depending on whether they are necessary for the respective case of use.

Figure 1:
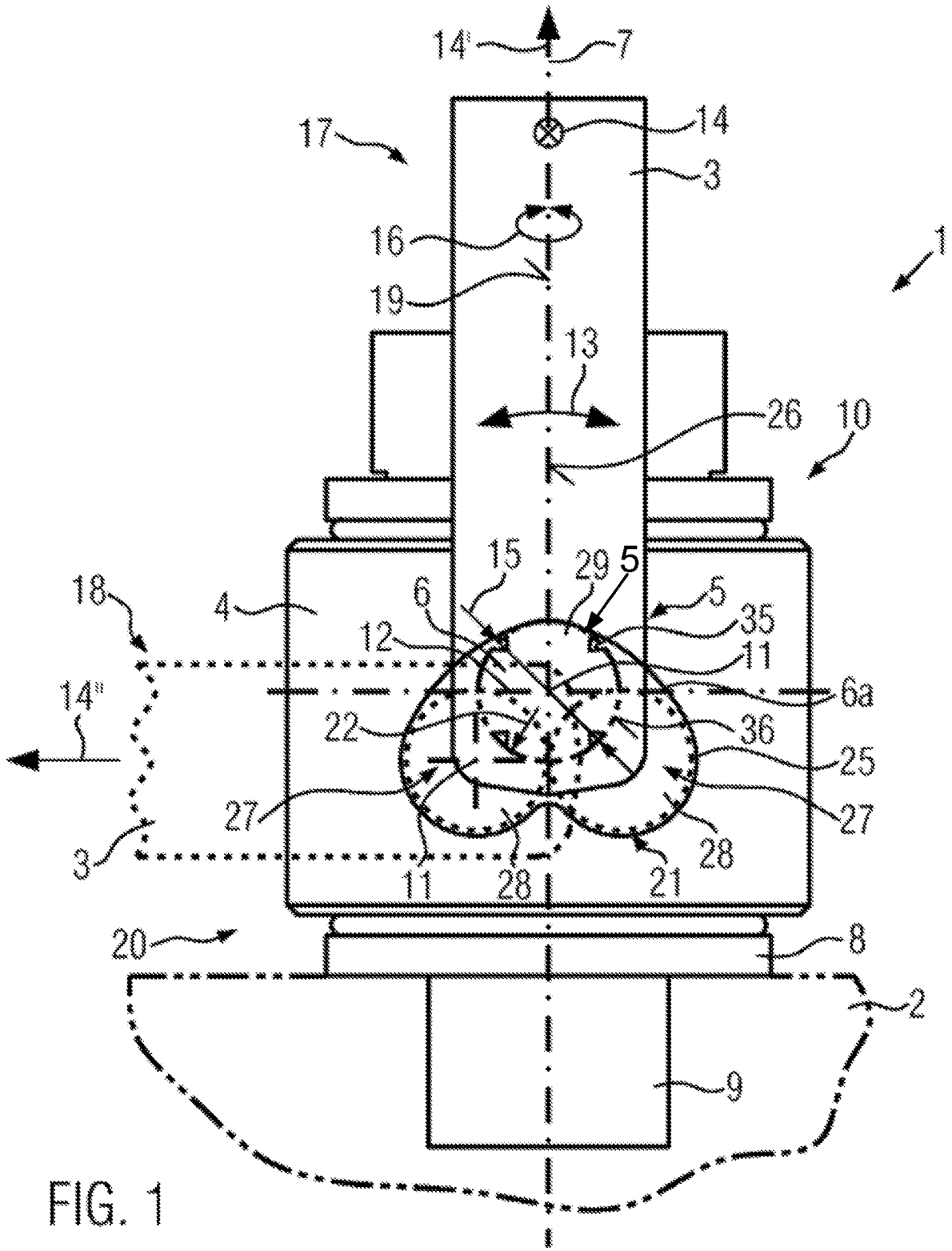
FIG. 1 shows a schematic side view of an embodiment of an anchor point according to the present invention.

To begin with, the structural design and the function of an anchor point 1 are explained with respect to FIG. 1. The anchor point 1, which is shown only exemplarily, is secured to an object 2, e.g. to a load which is to be lashed or moved. A retainer bracket 3 of the anchor point may have fastened thereto a fastening means in the form of e.g. hooks, rings, karabiners or grommets, chains, belts or ropes. The retainer bracket 3 may also have the shape of a closed ring.

The retainer bracket 3 is supported on a base 4 such that it is tiltable relative to the base 4. To this end, at least one bearing point 5 is provided. The bearing point 5 may comprise e.g. a bearing pin 6 whose cross-section is shown, only exemplarily, in a circular shape. Also eccentric and/or asymmetrically round, e.g. cam-shaped, wedge-shaped, oval or elliptical cross-sections as well as combinations of such cross-sections are possible. The bearing pin 6 may be supported in a reception means **6*a* of the base 4. The reception means 6*a* may be defined by an opening 6*a* of the base 4 into which the bearing pin 6** projects.

The base 4 is configured for fixing to an object 2 such that it is rotatable about an axis of rotation 7. To this end, the anchor point 1 may comprise a foot 8, which is adapted to be secured directly to the object 2 and which is e.g. welded to or, as shown, screwed onto the object 2 by means of a threaded pin 9. The foot 8 is stationary with respect to the object 2. The foot 8 and the base 4 have arranged between them a bearing that is not shown in detail, e.g. at least one plain bearing, at least one roller bearing or a combination thereof, said bearing providing between the base 4 and the foot 8 a loadable connection, which is smoothly rotatable about the axis of rotation 7. Via a counterholder 10, the base 4 is secured against a movement away from the object 2 in the direction of the axis of rotation 7. The counterholder 10 may e.g. be a nut and/or a part welded to the foot and/or establishing a form-fit connection therewith.

Also the retainer bracket 3 is provided with a bearing point 5 preferably on the side which is diametrically opposed relative to the axis of rotation 7 and which cannot be seen in FIG. 1.

The retainer bracket 3 is tiltable relative to the base 4 about a tilt axis 11. The tilt axis 11 is especially located in a plane 12 extending perpendicular to the axis of rotation 7. The tilting movement, which the retainer bracket 3 can execute, is schematically shown in FIG. 1 by the double arrow 13. The movability of the tilt axis 11 relative to the base 4 is accomplished e.g. in that at least one bearing pin 6 is held in the reception means **6*a* such that it is able to carry out not only a rotary but also a translational movement, at least when the retainer bracket 3** is oriented along the axis of rotation.

The tilt axis 11 is movable relative to the base 4, in particular in the direction of the axis of rotation 7 and/or at an acute angle relative to the axis of rotation 7, said acute angle being directed away from the retainer bracket 3. This has the effect that, at the position shown in FIG. 1, a force 14, which acts on the retainer bracket 3 and is effective parallel to the tilt axis 11 and the effective direction of which intersects the axis of rotation 7, will orient the retainer bracket 3 immediately in the direction of the force 14.

The movability of the tilt axis 11 relative to the base 4 exceeds in particular a mere play in the bearing points 5. The movability is e.g. between approximately one fifth up to approximately three times the diameter 15 of a bearing point 5 or of a bearing pin 6, if the bearing point 5 is configured in the form of a bearing pin 6.

The tilt axis 11 or at least one of the bearing points 5 is movable, in particular in the direction of rotation 16 of the base, about the axis of rotation 7 of the latter relative to the base 4 and/or in the direction of the axis of rotation 7 relative to the base 4. Preferably, a movability is given simultaneously in both directions. Also preferably, both bearing points 5 exhibit this kind of movability.

FIG. 1 shows the retainer bracket 3 in solid lines at a first operating position 17, the retainer bracket 3 assuming this first operating position 17 automatically, when a force 14' is directed in the direction of the axis of rotation 7.

A second operating position 18 is shown schematically in FIG. 1 by a triple dotted phantom line. A plane 19 defined by the retainer bracket 3 preferably extends, at the first operating position 17, approximately parallel to the axis of rotation 7 and, at the second operating position 18, approximately transversely to the axis of rotation 7. The retainer bracket 3 assumes the second operating position 18 automatically, when the force 14' is directed perpendicular to the axis of rotation 7. As can be seen, the tilt axis 11 at the second operating position 18 has moved relative to its position at the first operating position 17. In particular at the second operating position 18, the tilt axis 11 may be located on a different level of the axis of rotation 7 and/or may have been rotated about the axis of rotation 7 relative to the base 4. This movability of the tilt axis 11 prevents the first operating position 17 from being stably assumed under a force 14 and it prevents the force 14 from causing then a sudden turnover of the retainer bracket 3 or a failure of the anchor point. The retainer bracket 3 is able to orient itself immediately in the direction of the force 14.

It will be of advantage when, in the condition in which the retainer bracket 3 is positioned transversely to the axis of rotation 7, as shown in FIG. 1, the bearing point 5 is located closer to the end 20 of the base 4 facing the object 2 than in the condition in which the retainer bracket 3 extends in the direction of the axis of rotation 7. This measure will reduce the torque acting on the foot 8 and on the fastening of the latter on the object 2 due to ??? the force 14" that acts transversely to the axis of rotation 7.

In order to obtain a controlled movement of the tilt axis 11, a mechanical constraining guide 21 of a bearing point 5 may be provided. The mechanical constraining guide 21 allows a movement of the at least one bearing point 5 only in certain directions 22.

In FIG. 1, it is guaranteed that the bearing point 5 is guided by a mechanical constrained guide insofar as the reception means 6*a* is configured as a motion link 25. Preferably, a motion link 25 is provided for each bearing point 5. The motion link 25 defines a reception means, especially a slotted reception means, for the bearing point 5, preferably when the bearing point 5 is configured in the form of a bearing pin 6, which slides in the motion link 25 like a sliding block.

The motion link 25 may be configured symmetrically with respect to a radial plane 26 comprising the axis of rotation 7. A guide section 27 of the motion link 25 extends at an oblique angle to the radial plane 26. The guide section 27 extends along the axis of rotation 7 as well as transversely thereto. It may be straight or curved. The angle at which the guide section 27 may extend relative to the radial plane 26 is an angle between 30° and approximately 60°, preferably an angle of about 45°.

The motion link 25 may comprise two guide sections 27, which are arranged in a V-shape. The two guide sections 27 may be inclined in opposite directions with respect to the radial plane 26.

The heart-shaped motion link 25 according to FIG. 1 comprises two end halt points 28 that are spaced apart in the direction of rotation 16 of the base 4. At the respective end halt points 28, the bearing point 5 is located e.g. at the second operating position 19. This operating position is automatically assumed, when a force 14" acting transversely to the direction of rotation 7 acts on the retainer bracket 3.

An intermediate halt point 29 is provided between the two end halt points 28 in the direction of rotation 16 of the base 4. This intermediate halt point 29 may additionally be displaced relative to the end halt points 28 in the direction of the axis of rotation 7. The bearing point 5 will e.g. automatically move to this intermediate halt point 29 at the first operating position 17, when a force 14' acts on the retainer bracket 3 in the direction of the axis of rotation 7.

Between the halt points 28, 29, the movability of the bearing point 5 is preferably not impaired. The intermediate halt point 29 blocks the movement of the bearing point 5 along the axis of rotation in a direction away from the end 20 of the base 4. Each end halt point 28 blocks the movement of the bearing point in a direction perpendicular to the axis of rotation 7 and in the direction of rotation 16, respectively.

In FIGS. 2 to 5, further possible embodiments of the motion link 25 are shown. The other elements of the anchor point 1 have here been omitted for the sake of simplicity.

Figure 2:
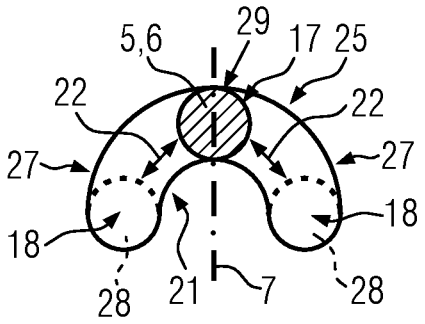
FIG. 2-5 show variants of a motion link of the anchor point according to FIG. 1 in a schematic representation.
Figure 3:
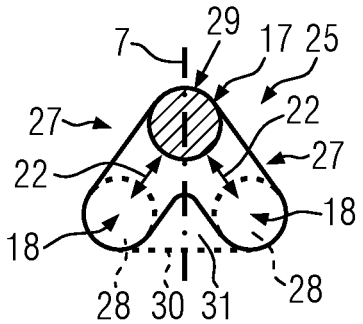

The motion links 25 of FIGS. 2 and 3 each have a symmetrical structural design and they each comprise two guide sections 27 as well as two end halt points 28 and an intermediate halt point 29.

Figure 4:
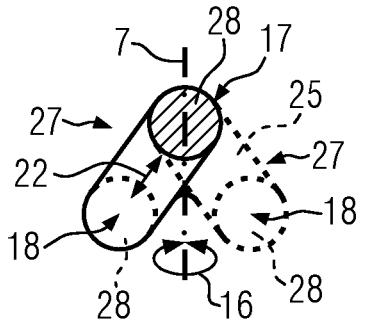
Figure 5:
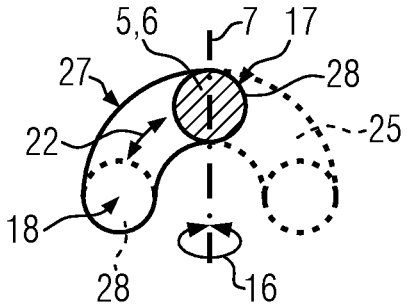

The motion links 25 according to FIGS. 4 and 5 each comprise only a single guide section 27 and they each have an asymmetric structural design with respect to a radial plane 26. The motion link 25, which is located on the side of the base 4 constituting the opposite side with respect to the axis of rotation 7 and which is shown by a dashed line in FIGS. 4 and 5, extends anti-symmetrically with respect to a radial plane located between the two motion links 25.

In the case of the motion links 25 according to FIGS. 4 and 5, only two end halt points 28 at the ends of the respective guide section 27 are provided. One of the end halt points 28 is here displaced relative to the end halt point 28 in the direction of rotation 16 as well as in the direction of the axis of rotation 7.

As can be seen from FIGS. 2 to 5, the motion link 25 may have straight and/or curved guide sections 27. In FIG. 3, the triple dotted phantom line 30 additionally shows schematically that there need not be any material 31 of the base 4 between the two end halt points 28, but that the bearing point 5 may move linearly between the end halt points 28. However, a more distinct separation of the guide sections 27 through the material 31 between the end halt points 28 will be of advantage, since the bearing point 5 can thus move immediately to the end halt point which is the right end halt point for the self-orientation of the retainer bracket 3 and will there be fixed. This reduces the dynamic load during the self-orientation.

One of the bearing points 5, preferably each bearing point 5, and one of the bearing pins 6, preferably each bearing pin 6, may be provided with at least one wear indicator 35. A wear indicator 35 may be configured as a groove or as a rib and may be located on an area of the bearing point 5, which comes into contact with the motion link 25. In the case of this embodiment, the motion link 25 serves as an inspection window, which allows the at least one wear indicator 35 to be inspected from outside of the anchor point 1. If, for example, the wear indicator 35 is no longer visible, the anchor point 1 or the retainer bracket 3 must be replaced.

Figure 6:
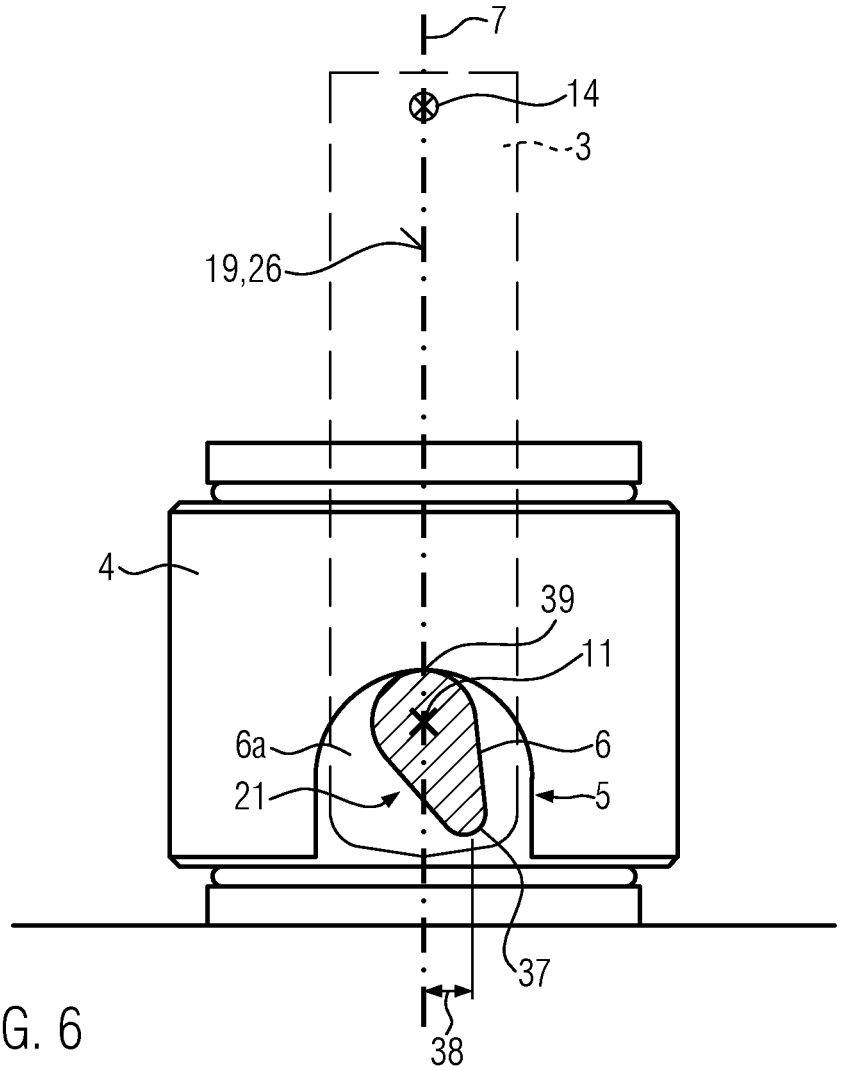
FIG. 6-9 show further variants of the anchor point according to FIG. 1 in a schematic representation.
Figure 7:
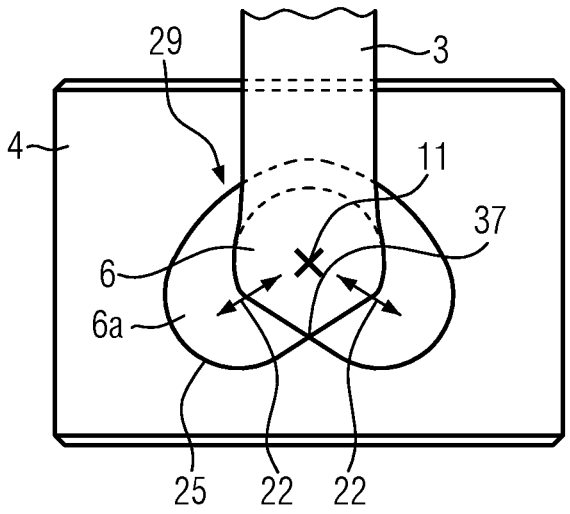

As can be seen in FIG. 6, a mechanical constraining guide 21 need not necessarily be realized by configuring the reception means 6*a* as a motion link 25. A reliable orientation of the retainer bracket 3 in the direction of the force 14 results e.g. from an asymmetrical structural design of the bearing pin 6 with respect to the plane 19 of the retainer bracket 3 and/or the radial plane 26. In this case, the reception means 6*a* may be configured symmetrically to the diameter plane extending through the axis of rotation 7. This is shown in FIGS. 6 and 7, the structural design according to FIG. 7 comprising a symmetrical motion link 25 with an asymmetrically configured bearing pin 6.

As can be seen in FIG. 6, the asymmetrical structural design of the bearing pin 6 may result from the fact that, when the retainer bracket 3 is oriented parallel to the axis of rotation 7, the pin has, on its side facing away from the retainer bracket 3, a contact point 37 that is spaced apart from the axis of rotation 7 by a certain amount 38. This results in a cam shape of the cross-section of the bearing pin 6. The reception means 6*a* may be arcuate in the case of this type of structural design, a top 39 of the arc pointing towards the retainer bracket 3 when the latter is at the position oriented along the axis of rotation 7. On the side facing away from the retainer bracket 3, the reception means may be configured linearly.

In order to allow the bearing pin 6 to enter into close contact with the reception means 6*a* across the largest possible area, the bearing pin 6 may have a circular arc section at its end located in the plane 19 and facing the retainer bracket 3.

The bearing pin 6 is again held in the reception means 6*a* such that it is able to carry out a rotary as well as a translational movement. In particular, the bearing pin 6 is able to move in the reception means 6*a* along the axis of rotation 7, when the retainer bracket 3 is oriented along the axis of rotation 7. This movability allows the retainer bracket 3 to follow the force 14 to a certain extent by lateral tilting until the contact point 37 enters into contact. The displacement 38 between the force transmission 14 and the contact point 37 will then lead to a torque that causes the retainer bracket 3 to tilt immediately and to orient itself along the force 14.

An asymmetric structural design of the bearing pin 6, as shown in FIG. 6, is not necessary, when a motion link 25 and a bearing pin 6 of the type shown in FIG. 7 are used. However, in order to prevent the contact point 37 from not blocking, in the event of a disadvantageous load, at the intermediate halt point 29, in particular at a projection 40 of the motion link 25 separating the guide sections 27, the contact point 37 and/or the projection 40 taper to the highest possible degree.

Such blocking can be avoided by the asymmetric structural design of the bearing pin 6.

Figure 8:
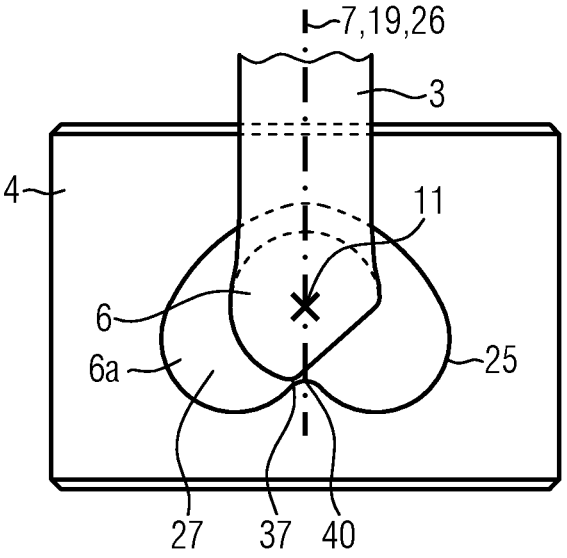

FIG. 8 shows an asymmetric structural design of the bearing pin 6, in the case of which the contact point 37 projects into a guide section 27 of the motion link 25. In this way, the bearing pin 6 can prevented from coming to lie on the projection 40 of the motion link, said projection 40 separating the motion link between the two guide sections 27. When, in the case of the structural design according to FIG. 8, the retainer bracket 3 follows the force 14 (cf. FIG. 6), the bearing pin 6 will automatically be threaded into the respective guide section 27 of the motion link 25 into which the contact point 37 projects. Just as in the case of the other structural designs, the bearing pin 6 is adapted to be displaced in the reception means 6*a* along the axis of rotation 7 and the plane 12, respectively, at least when the retainer bracket 3 is oriented along the axis of rotation 7.

Figure 9:
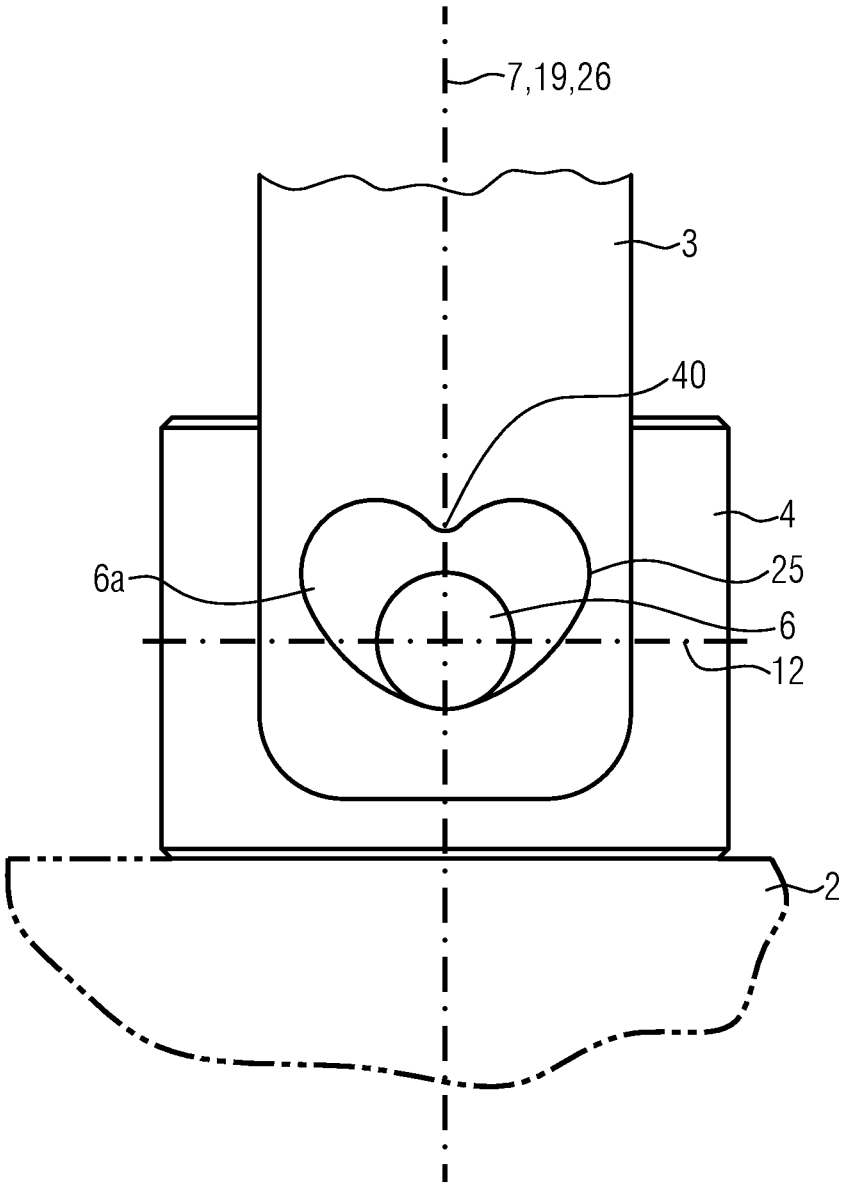

In the above embodiments, the bearing pin 6 is, only exemplarily, always attached to the retainer bracket 3 and supported in a reception means 6*a* of the base. The bearing pin 6 may just as well be attached to the base 4. This is shown in FIG. 9. In this case, the bearing point 5 of the retainer bracket 3 will then be configured as a reception means 6*a* for tiltably supporting in the retainer bracket 3 the bearing pin 6, which is then provided on the side of the base. The reception means 6*a* may then, as described above, be configured in the shape of a motion link according to a further development. In this case, the motion link may be configured, with respect to the plane 12, mirror-symmetrically to the variants where the bearing pin 6 acts as a bearing point 5, but identical in all other respects. The projection 40 is thus arranged on the section of the motion link 25 that is further away from the object 2. Also in this case, the bearing pin 6 may be provided with wear markers, which, thanks to the motion link 25, are easily visible from outside. As in the case of the preceding embodiments, the at least one wear marker need not be provided on the bearing pin. It may just as well be provided on the motion link 25.

REFERENCE NUMERALS

1 anchor point
2 object
3 retainer bracket
4 base
5 bearing point
6 bearing pin
6*a* reception means
7 axis of rotation
8 foot
9 threaded pin
10 counterholder
11 tilt axis
12 plane transversely to the axis of rotation
13 tilting movement
14, 14', 14" force
15 diameter of the bearing pin
16 direction of rotation
17 first operating position
18 second operating position
19 plane of the retainer bracket
20 base end facing the object
21 mechanical constraining guide of the bearing point
22 directions of movement allowed by the constraining guide
25 motion link
26 radial plane
27 guide section of the motion link
28 end halt point of the motion link
29 intermediate halt point of the motion link
30 phantom line
31 material between end halt points
35 wear indicator
36 area of the bearing point with wear indicator
37 contact point
38 displacement
39 top of the arc
40 projection of the motion link

The invention claimed is:

1. An anchor point comprising a base, which base has provided thereon at least one heart-shaped motion link and is configured for fixing to an object such that it is rotatable about an axis of rotation, and further comprising a retainer bracket for fastening a fastening means, the retainer bracket being held on two bearing points on the base such that it is tiltable about a tilt axis relative to the base, characterized in that the tilt axis is movable relative to the base, wherein at least one of the bearing points is guided such that it is movable relative to the base.

2. The anchor point according to claim 1, characterized in that at least one bearing point is held on the base such that it is movable relative to the base in the direction of rotation of the latter.

3. The anchor point according to claim 1, characterized in that the tilt axis is rotatable about the axis of rotation relative to the base.

4. The anchor point according to one of the claim 1, characterized in that at least one bearing point on the base is held on the base translationally in the direction of the axis of rotation.

5. The anchor point according to claim 1, characterized in that the tilt axis is tiltable perpendicular to the axis of rotation relative to the base.

6. The anchor point according to claim 1, characterized in that at least one bearing point is held on the base such that it is movable from a first operating position to a second operating position, wherein the bearing point is located on respective different levels of the axis of rotation at the first and second operating positions and/or is rotated at the first operating position relative to the base about the axis of rotation with respect to the second operating position.

7. The anchor point according to claim 1, characterized in that the motion link comprises two end halt points spaced apart in the direction of rotation of the base and an intermediate halt point for the bearing point, said intermediate halt point being located between the two end halt points in the direction of rotation of the base and being displaced relative to the end halt points in the direction of the axis of rotation.

8. The anchor point according to claim 1, characterized in that, for at least one bearing point, a wear indicator is provided, which is arranged such that it can be viewed from outside the anchor point through the motion link.

9. The anchor point according to claim 1, characterized in that, at least under load, at least one bearing point is, when the retainer bracket extends transversely to the axis of rotation, located closer to a base end facing the object in the mounted condition than when the retainer bracket is, under load, located in the direction of the axis of rotation.

10. The anchor point according to claim 1, characterized in that at least one bearing point comprises an asymmetrically configured bearing pin.

11. The anchor point according to claim 1, characterized in that at least one bearing point comprises a reception means into which a bearing pin of the base projects.

12. An anchor point comprising a base, the base having provided thereon at least one motion link and being configured for fixing to an object such that it is rotatable about an axis of rotation, wherein the motion link is configured symmetrically with respect to a radial plane comprising the axis of rotation, the anchor point further comprising a retainer bracket for fastening a fastening means, the retainer bracket being held on two bearing points on the base such that it is tiltable about a tilt axis relative to the base, characterized in that the tilt axis is movable relative to the base, and wherein at least one of the bearing points is guided such that it is movable relative to the base.

13. An anchor point comprising a base, the base having provided thereon at least one motion link and being configured for fixing to an object such that it is rotatable about an axis of rotation, wherein the motion link comprises two guide sections, which are arranged in a V-shape, the anchor point further comprising a retainer bracket for fastening a fastening means, the retainer bracket being held on two bearing points on the base such that it is tiltable about a tilt axis relative to the base, characterized in that the tilt axis is movable relative to the base, and wherein at least one of the bearing points is guided such that it is movable relative to the base.

* * * * *